US011542894B2

(12) United States Patent
Fink et al.

(10) Patent No.: US 11,542,894 B2
(45) Date of Patent: Jan. 3, 2023

(54) METHOD FOR TESTING THE FUNCTION OF A FUEL TANK SYSTEM OF AN INTERNAL COMBUSTION ENGINE

(71) Applicant: Volkswagen Aktiengesellschaft, Wolfsburg (DE)

(72) Inventors: Rene Fink, Wismar (DE); Stephan Wassmann, Isenbuettel (DE); Jacky Oelscher, Arendsee OT Hoewisch (DE); Harm Pralle, Braunschweig (DE); Bjoern Froehlich, Gifhorn (DE); Silke Weddig, Braunschweig (DE); Georg Dieterle, Taufkirchen (DE); Aleksandar Tesic, Wolfsburg (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 0 days.

(21) Appl. No.: 17/694,107

(22) Filed: Mar. 14, 2022

(65) Prior Publication Data

US 2022/0290638 A1 Sep. 15, 2022

(30) Foreign Application Priority Data

Mar. 15, 2021 (DE) ..... 10 2021 202 516.1

(51) Int. Cl.
*F02M 25/08* (2006.01)

(52) U.S. Cl.
CPC .... *F02M 25/0818* (2013.01); *F02M 25/0836* (2013.01)

(58) Field of Classification Search
CPC ..... F02M 25/0818; F02M 25/0836; F02M 25/089; F02M 2025/0845; F02M 25/0809
See application file for complete search history.

(56) References Cited

U.S. PATENT DOCUMENTS

| | | | | |
|---|---|---|---|---|
| 6,840,233 | B2 | 1/2005 | Lingenhult et al. | |
| 7,047,798 | B2 | 5/2006 | Esteghlal et al. | |
| 9,551,304 | B2 * | 1/2017 | Haefele | F02M 25/0809 |
| 9,945,330 | B2 * | 4/2018 | Meinken | F02M 25/0809 |
| 10,197,017 | B2 * | 2/2019 | Casetti | G07C 5/0825 |
| 10,968,869 | B2 * | 4/2021 | Kato | F02M 25/08 |

(Continued)

FOREIGN PATENT DOCUMENTS

| | | | |
|---|---|---|---|
| DE | 10150420 | A1 | 4/2003 |
| DE | 60210773 | T2 | 4/2007 |
| DE | 102011084403 | A1 | 4/2013 |

(Continued)

*Primary Examiner* — Xiao En Mo
(74) *Attorney, Agent, or Firm* — Muncy, Geissler, Olds & Lowe, P.C.

(57) ABSTRACT

A method for testing the function of a fuel tank system of an internal combustion engine, the fuel tank system, whereby a gas transport device is operated and a shutoff valve is actuated by means of PWM, whereby the shutoff valve is opened and closed multiple times according to a PWM signal for implementing a defined opening state, a pressure oscillation of the purge gas, which results due to the corresponding opening and closing movements of the shutoff valve, being ascertained and evaluated with the aid of the pressure sensor according to a frequency diagnosis, and a distinction being made between an operability and a malfunction, based on the result of the evaluation.

9 Claims, 4 Drawing Sheets

(56) References Cited

U.S. PATENT DOCUMENTS

| | | | |
|---|---|---|---|
| 2015/0114361 | A1 | 4/2015 | Matsunaga et al. |
| 2019/0040821 | A1 | 2/2019 | Ishihara et al. |

FOREIGN PATENT DOCUMENTS

| | | | |
|---|---|---|---|
| DE | 102014208987 | A1 | 11/2015 |
| DE | 102016122408 | A1 | 6/2017 |
| DE | 112017001972 | T5 | 1/2019 |
| WO | WO2018108761 | A1 | 6/2018 |

* cited by examiner

METHOD FOR TESTING THE FUNCTION OF A FUEL TANK SYSTEM OF AN INTERNAL COMBUSTION ENGINE

This nonprovisional application claims priority under 35 U.S.C. § 119(a) to German Patent Application No. 10 2021 202 516.1, which was filed in Germany on Mar. 15, 2021 and which is herein incorporated by reference.

BACKGROUND OF THE INVENTION

Field of the Invention

The present invention relates to a method for testing the function of a fuel tank system of an internal combustion engine.

Description of the Background Art

Fuel tank systems for internal combustion engines of motor vehicles regularly include a venting line, which makes it possible to release a rising pressure in the fuel tank of the tank system as a result of, for example, fuel evaporating into the surroundings at high ambient temperatures. As little fuel vapor as possible should reach the surroundings, due to emission regulations. This is prevented in that a fuel vapor filter, regularly in the form of an active carbon filter, is integrated into the venting line, which absorbs the fuel vapors.

To regenerate the fuel vapor filter, tank systems of this type are additionally provided with a purge gas line, which is connected to the fuel vapor filter, on the one hand, and to the fresh gas tract of the internal combustion engine, on the other hand. During the operation of the internal combustion engine, ambient air, which flows through and thereby purges the fuel vapor filter, may be temporarily sucked in via a surroundings opening of the fuel vapor filter with the aid of the underpressure prevailing in the fresh gas tract in the area of the opening of the purge gas line. The fuel vapors from the fuel vapor filter are thus supplied to the combustion chambers of the combustion unit of the internal combustion engine via the fresh gas tract.

A lack of tightness of the venting system of a tank system would result in an uncontrolled escape of fuel vapors into the surroundings, which is to be avoided.

WO 2018/108761 A1, which is incorporated herein by reference, discloses a method for testing the sealing tightness of a fuel tank system of an internal combustion engine. The fuel tank system comprises a fuel tank, a fuel vapor filter, which is fluid-conductively connected to a surroundings opening, a venting line leading from the fuel tank to the fuel vapor filter, a purge gas line leading from the fuel vapor filter to a fresh gas tract of the internal combustion engine, a gas transport device integrated into the purge gas line, and a shutoff valve integrated into the purge gas line, which is arranged between an opening of the purge gas line into the fresh gas tract and the gas transport device. To test the tightness of a fuel tank system of this type, it is provided to distinguish between a sufficient and insufficient tightness by comparing at least one value or value profile of a parameter, which is ascertained in a defined operating state of the fuel tank system and corresponds to an operating parameter of the compressor or the pressure in at least one section of the purge gas line to be tested, with a corresponding setpoint value or setpoint value range representing this operating state, which corresponds to a sufficient tightness.

A tank venting system for an internal combustion engine is known from DE 10 2011 084 403 A1, which corresponds to US 2014/0345574, which includes a fuel tank, a fuel vapor filter, a tank venting valve and at least one check valve. A pressure sensor is arranged between the tank venting valve and the check valve. To diagnose the tank venting system, an underpressure is set between the tank venting valve and the check valve, which is lower than the ambient pressure. The set pressure is changed by actuating the tank venting valve. The change of the pressure in the line between the tank venting valve and the check valve is measured with the aid of the pressure sensor and assigned to the actuation of the tank venting valve. The operation of the tank venting line, the check valve and the tank venting valve is inferred from the correlation of the opening state of the tank venting valve and the change of the pressure in the line between the tank venting valve and the check valve. In particular, the tightness of the tank venting system in the section between the tank venting valve and the check valve may also be inferred.

SUMMARY OF THE INVENTION

It is therefore an object of the present invention to provide an advantageous possibility for testing the function of a fuel tank system of an internal combustion engine.

According to an exemplary embodiment of the invention, a method is provided for testing the function of a fuel tank system of an internal combustion engine, in particular an internal combustion engine of a motor vehicle, the fuel tank system, comprising at least a fuel tank; a fuel vapor filter (preferably a sorption filter, in particular an active carbon filter), which is fluid-conductively connected to a surroundings opening; a venting line leading from the fuel tank to the fuel vapor filter; a purge gas line leading from the fuel vapor filter to a fresh gas tract of the internal combustion engine; a gas transport device (compressor of blower) integrated into the purge gas line for transporting purge gas through the purge gas line; a shutoff valve, which is arranged between an opening of the purge gas line into the fresh gas tract and the gas transport device in the purge gas line; and a pressure sensor integrated into the purge gas line.

Within the scope of the method according to the invention, the gas transport device is operated at least temporarily and the shutoff valve actuated by means of PWM (pulse width modulation), whereby the shutoff valve is opened and closed multiple times according to a PWM signal for implementing a defined opening state, a pressure oscillation in the purge gas, which results due to the corresponding opening and closing movements of the shutoff valve, being ascertained and evaluated with the aid of the pressure sensor according to a frequency diagnosis, and a distinction being made between an operability and a malfunction, based on the result of the evaluation.

The advantage of this method is that the function test is implemented within the scope of the frequency diagnosis during a regular operation of the gas transport device, which is consequently carried out for a purging of the fuel vapor filter, and no diagnostic operation of the gas transport device or the fuel tank system must be carried out independently thereof. As a result, it may preferably be provided that the operation of the gas transport device carried out within the scope of a method according to the invention is also or even primarily used for such a purging of the fuel vapor filter. The function test may therefore always be carried out when the gas transport device is operated and the shutoff valve is actuated, whereby a nearly continuous function test may advantageously result during the operation of the internal combustion engine. The diagnosis may consequently be carried out continuously during an operation of the internal combustion engine, an operation of the internal combustion engine being equated with an active operation of at least one component of the internal combustion engine. An operation of a combustion unit is not absolutely necessary therefor. Additionally or alternatively, however, it may also be provided to operate the gas transport device exclusively for the purpose of the function test.

A distinction between the operability and the malfunction may be, for example, that a distinction is made between a sufficient tightness (operability) and an insufficient tightness (malfunction). An insufficient tightness of this type may result as a consequence of or a more or less significant leak opening of the fuel tank system in the area of the purge gas line or as a consequence of a loosening of the purge gas line from one of these connected components. Additionally or alternatively, a distinction between the operability and malfunction may also be to detect a possible clogging or blocking of the purge gas line (as the malfunction). Likewise, it is possible to test, with the aid of the function test, the operability of components of the fuel tank system, in particular of components which come into contact with the purge gas, for example the purge gas transport device, the pressure sensor or the shutoff valve. A testing of the shutoff valve may also take place, in particular also based on a leak test, because a leak of this type may also be the result of a non-actuatable or no longer completely actuatable shutoff valve.

The method according to the invention may be preferably implement in that the shutoff valve is opened farther the greater the PWM signal. An embodiment of this type may result from the fact that a basic position of the shutoff valve is the (completely) closed position. This basic position may be implemented, for example with the aid of a spring element, which places (i.e. presses or pulls) the shutoff valve or a valve body thereof into the closed position. The embodiment of the shutoff valve having a closed position as the basic position may be used, in particular, to ensure a continuous separation between the purge gas line and the fresh gas tract of the internal combustion engine in the case of a malfunction or a failure of the shutoff valve.

In the case of a complete operability of the fuel tank system during the operation of the gas transport device and upon an actuation of the shutoff valve, a pressure oscillation may be ascertained with the aid of the pressure sensor, which corresponds to a superimposed sinusoidal and cosinusoidal oscillation (or which my be ascertained from the measured value signal). If a superimposed sinusoidal and cosinusoidal oscillation of this type may not be ascertained within the scope of a method according to the invention, this may be interpreted in that the malfunction is present. Additionally or alternatively, however, a malfunction may also be ascertained if a superimposed sinusoidal and cosinusoidal oscillation is ascertained with the aid of the pressure sensor within the scope of the method according to the invention, but the latter does not, with respect to at least one comparison value, correlate with a superimposed sinusoidal and cosinusoidal oscillation, which should occur in the case of a complete operability of the fuel tank system. For this purpose, a comparison value may preferably be ascertained from the detected superimposed sinusoidal and cosinusoidal oscillation, which is compared with a setpoint value (range) corresponding to a setpoint sinusoidal and cosinusoidal oscillation, a deviation from the setpoint value (range) being detected as a malfunction. To ascertain the comparison value, the sinusoidal and cosinusoidal oscillations superimposed on each other may be squared and added up. This generally known mathematical method is derived from the discrete Fourier transform.

The frequency diagnosis carried out within the scope of the method according to the invention (at least depending on the conditions) supplies advantageous diagnostic results, in particular upon an actuation of the shutoff valve, within an average range of the PWM signal, because a formation of the pressure oscillation takes place only to a limited extent in the case of a shutoff valve which is opened too far as well as one which is closed too far, which makes the ascertainment and evaluation thereof more difficult. As a result, it may be provided within the scope of a method according to the invention that the frequency diagnosis is carried out while the shutoff valve is actuated within a range of the PWM signal between a lower limit value (greater than 0%, in particular 20%) and an upper limit value (less than 100%, in particular 80%). If the actuation of the shutoff valve is outside this range, it may be provided that no function test of the fuel tank system is carried out, or that the function test takes place based on a diagnosis other than the frequency diagnosis.

It may be provided, in particular, that, according to a pressure change diagnosis using an operating gas transport device, at least two pressure measurements are carried out with the aid of the pressure sensor, the pressure measurements taking place upon different actuations of the shutoff valve, and a pressure change (in particular in the form of a relative value) ascertained by a comparison of these pressure measurements being compared with a setpoint value, a distinction being made between an or the operability and a or the malfunction by means of this comparison. One advantage of this diagnosis is the relatively high sensitivity, so that an accurate evaluation may take place even in the case of a shutoff valve opened to a relatively great extent (preferably according to a relatively great actuation of the shutoff valve). In the case of the pressure change diagnosis, at least one of the pressure measurements may therefore preferably be carried out upon an actuation of the shutoff valve using a PWM signal which is greater than the stated upper limit value. It may preferably be provided that the two pressure measurements relate to an opening or closing movement of the shutoff valve within the scope of the PWM actuation, so that a first pressure measurement takes place, in particular, at the beginning of an opening or closing movement of this type, and the second pressure measurement takes place at the end of the corresponding opening or closing movement. It may particularly preferably be provided that one measurement is carried out upon an actuation of the shutoff valve below the aforementioned lower limit value and one measurement is carried out upon an actuation of the shutoff valve above the aforementioned upper limit value.

It may furthermore be provided that, according to an overpressure diagnosis, at least one pressure measurement is carried out with the aid of the pressure sensor, and a pressure value is ascertained thereby, an analysis with regard to the presence of an overpressure being carried out by a comparison of the pressure value with an ambient pressure value, which was ascertained with the aid of an ambient pressure sensor, a distinction being made between an or the operability and a or the malfunction as a function of the presence of the overpressure. A corresponding threshold or limit value for the overpressure may also be defined for this distinction between the operability and the malfunction.

The frequency diagnosis and the pressure change diagnosis use the actuation of the shutoff valve and the pressure sensor for the function tests, which preferably monitor the section of the purge gas line situated between the pressure sensor and the shutoff valve. Fault patterns situated between the gas transport device and the pressure sensor may possibly not be found in certain engine operating states during an operation of the combustion unit of the internal combustion engine. To also ensure that faults may also be reliably detected for the section of the purge gas line located between the gas transport device and the pressure sensor, according to the overpressure diagnosis, an overpressure generated by the gas transport device may be used, which may be detected by the pressure sensor.

The following advantages of the overpressure diagnosis result therefrom: The diagnosis may take place if no active purging takes place via the purge gas line. A (prior) actuation of the shutoff valve is not necessary; an influence resulting therefrom on the operation of the combustion unit may be avoided thereby. A better detection of the fault location in the fuel tank system may furthermore be implemented. Moreover, a fault detection is possible, depending on the operating speed of the gas transport device, which also makes it possible to detect a defect of the gas transport device, e.g., if the compression or transport of the purge gas no longer works.

The overpressure diagnosis may preferably be carried out during an actuation of the shutoff valve using a PWM signal which is less than the stated lower limit value, because an execution of the other diagnosis types is then less suitable.

The method according to the invention may be used, in particular, for a fuel tank system of an internal combustion engine, which comprises a spark-ignited and possibly quantity-controlled combustion unit, in particular one operated according to the Otto principle, because the fuels used for operating combustion units of this type are relatively volatile (in particular compared to diesel fuel), whereby not only the special need for a tank venting but also a function test, in particular a testing of the tightness of the fuel tank system, is justifiable.

The designation "fuel vapor filter" does not mean, according to the invention, that the latter must necessarily filter the volatile fuel in gaseous form. Instead, the fuel may have already been (partially) condensed out during the filtering.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
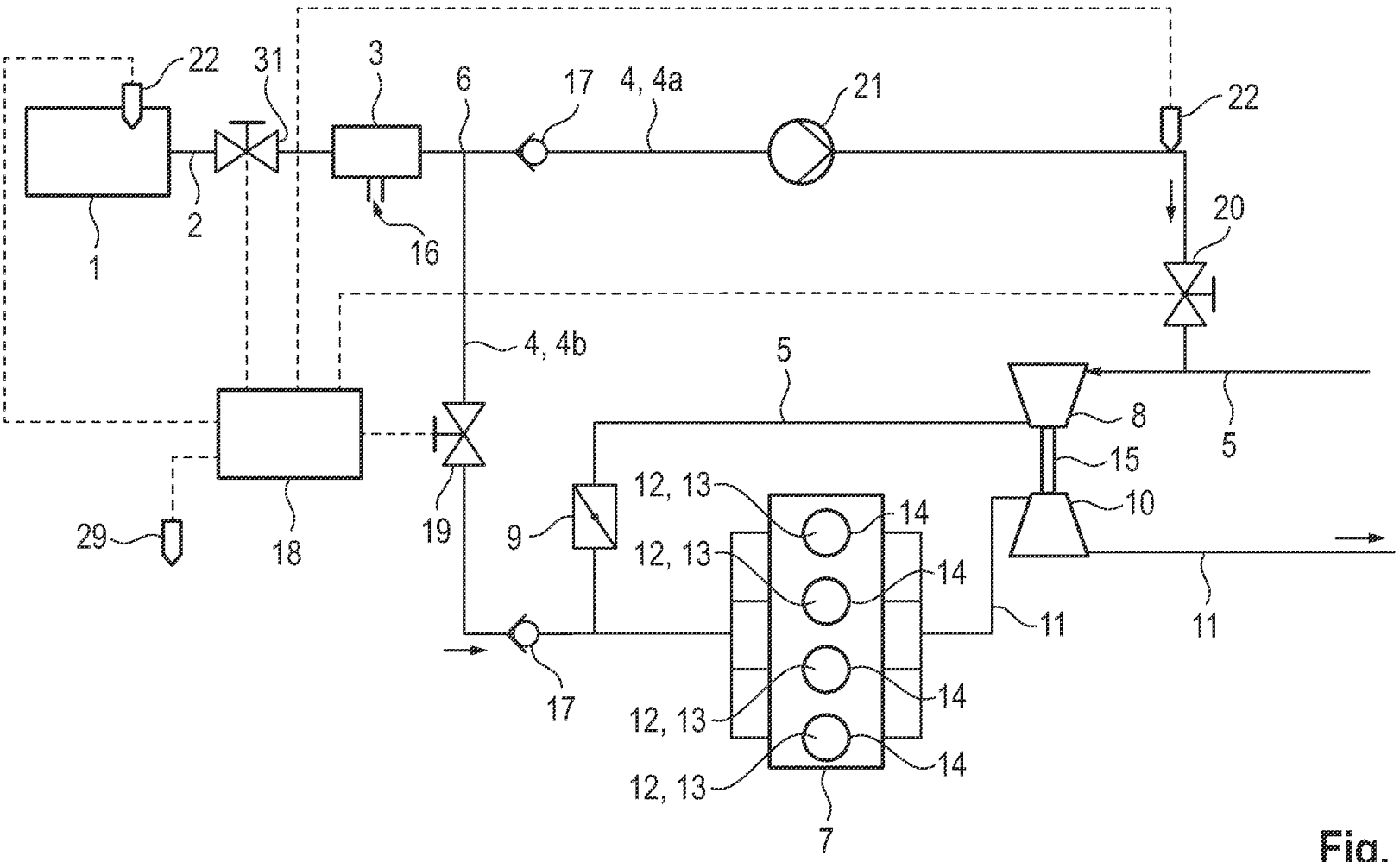
FIG. 1 shows a fuel tank system of an internal combustion engine, which is suitable for carrying out a method according to the invention.

FIG. 1 shows a fuel tank system of an internal combustion engine. It comprises a fuel tank 1, which is connected to a fuel vapor filter 3 via a venting line 2, a tank shutoff valve 31 being able to be integrated into venting line 2, as illustrated in FIG. 1. Fuel vapor filter 3 may be designed, in particular, as an active carbon filter or at least to comprise a filter of this type. Fuel vapor filter 3 is furthermore connected to a fresh gas tract 5 of the internal combustion engine via a purge gas line 4, purge gas line 4 running in two branches 4*a*, 4*b*, starting from a branch 6, of which a first branch 4*a* opens into fresh gas tract 5 upstream from a fresh gas compressor 8 integrated into fresh gas tract 5 (with regard to the flow direction of fresh gas in fresh gas tract 5 in the direction of a combustion unit 7 of the internal combustion engine), and second, optionally present branch 4*b* opens downstream from fresh gas compressor 8 and in particular also downstream from a throttle valve 9 integrated into fresh gas tract 5, likewise downstream from fresh gas compressor 8. Fresh gas compressor 8 is part of an exhaust gas turbocharger, which further comprises an exhaust gas turbine 10, which is integrated into exhaust tract 11 of the internal combustion engine.

During the operation of the internal combustion engine, mixtures of fresh gas, which is completely or primarily made up of ambient air, and fuel, which may have been injected, for example, directly into combustion chambers 12, are combusted in the known manner in a defined sequence in combustion chambers 12 of combustion unit 7, which are partially limited by cylinders 13 of combustion unit 7. The generated pressure increases in combustion chambers 12 cause longitudinally axially movably guided pistons 14 to move in cylinders 13. These movements of pistons 14 are translated into a rotational movement of a crankshaft, with connecting rods connected therebetween, the guidance of pistons 14 via the connecting rods with the aid of the crankshaft simultaneously resulting in a cyclical back-and-forth movement of pistons 14.

The exhaust gas resulting during the combustion of the fresh gas/fuel mixtures in combustion chambers 12 is removed via exhaust tract 11 and flows through exhaust gas turbine 10, which results in a rotating driving of a turbine rotor. This rotation of the turbine rotor is transmitted to a compressor rotor of fresh gas compressor 8 with the aid of a shaft 15, whereby fresh gas compressor 8 ensures a compression of the fresh gas supplied to combustion unit 7 via fresh gas tract 5.

Fuel vapor filter 3 of the fuel tank system is furthermore gas-conductively connected to the surroundings, for which purpose it forms a surroundings opening 16.

Fuel tank 1 is partially filled with liquid fuel, a portion of this fuel being evaporated, so that fuel in the gaseous aggregate state is also present in fuel tank 1. Such an evaporation of fuel in fuel tank 1 is intensified by a relatively high temperature of the fuel, which is the case, in particular, at comparatively high ambient temperatures. To avoid an impermissibly high overpressure in fuel tank 1, due to this evaporation, the possibility of an at least partial pressure compensation using the ambient pressure via venting line 2 and fuel vapor filter 3 comprising surroundings opening 16 is provided, the fact that a pressure compensation of this type results in an escape of fuel vapors into the surroundings being prevented by fuel vapor filter 3.

Such a venting of fuel tank 1 results in an increasing saturation of fuel vapor filter 3, which, in turn, makes it necessary to regenerate the latter at regular intervals. A purging of fuel vapor filter 3 is provided for this purpose, ambient air being sucked in via surroundings opening 16. This ambient air flows through fuel vapor filter 14, whereby fuel molecules absorbed in fuel vapor filter 3 are carried along by the ambient air and are introduced into fresh gas tract 5 via purge gas line 4. This fuel may then be supplied thereby for a combustion in combustion chambers 12 of combustion unit 7. A purging of fuel vapor filter 3 in this manner is only periodically provided and always during the operation of combustion unit 7, because only then may the fuel introduced into fresh gas tract 5 by the purging of fuel vapor filter 3 also be safely supplied for a combustion in combustion chambers 12.

A sufficient pressure gradient from the ambient pressure to the pressure in fresh gas tract 5 in the area of the openings of purge gas line 4, which is not always given, due to highly fluctuating pressures in fresh gas tract 5, is necessary for purging fuel vapor filter 3. With regard to the pressure gradient from the ambient pressure to the pressure in fresh gas tract 5, not even a pressure gradient but a pressure increase is often present in the area of the opening of second branch 4*b* of purge gas line 4, because this opening is situated in the area of the charge air section of fresh gas tract 4 extending between fresh gas compressor 8 and combustion unit 7, in which the fresh gas is often present at an increased pressure as a result of a compression by fresh gas compressor 8. Due to an arrangement of this opening (as close as possible) downstream from throttle valve 9, a pressure reduction effectuated by throttle valve 9 may be utilized; however, this pressure reduction is often not sufficient to actually implement a sufficient pressure gradient over second branch 4*b* of purge gas line 4. A check valve 17 is therefore integrated into this second branch 4*b* of purge gas line 4, by means of which this branch 4*b* of purge gas line 4 may be automatically held in the closed position if an overpressure is present in the area of the corresponding opening, compared to the second of second branch 4*b* of purge gas line 4 situated on the other side of check valve 17. In addition, a (second) shutoff valve 19, which may be actively actuated with the aid of control device 18, is integrated into second branch 4*b* of purge gas line 4 upstream from check valve 17 (with respect to the through-flow direction during the purging of fuel vapor filter 3).

First branch 4*a* of purge gas line 4, on the other hand, opens into a section of fresh gas tract 5 situated upstream from fresh gas compressor 8, not only a check valve 17 but also a (first) shutoff valve 20 being integrated into this branch 4*a* of purge gas line 4, which is arranged as close as possible to the opening of this branch 4*a* or is preferably integrated thereinto. A sufficient pressure gradient, compared to the ambient pressure present at surroundings opening 16, is at least temporarily present in the section of fresh gas tract 5 in the area of the opening of first branch 4*a*. However, this is not always the case.

To enable a purging of fuel vapor filter 3, so that a complete saturation thereof may be safely prevented, the fuel tank system further comprises a gas transport device 21, which may be designed, for example, as a centrifugal supercharger. Due to an operation of this gas transport device 21, ambient air may be actively sucked in via surroundings opening 16, which then flows through fuel vapor filter 3 for the purging thereof and is transported to the opening of first branch 4*a* of purge gas line 4 via gas transport device 21. (Second) shutoff valve 19, integrated into second branch 4*b* of purge gas line 4 is then held in the closed position; however, automatically closing check valve 17 at least prevents a sucking in of fresh gas from the charge air section of fresh gas tract 5 via the opening of second branch 4*b*.

Since the fuel vapors escaping into the surroundings are potentially harmful to the environment and health, it is sensible and, in part also required by law, to regularly test the fuel tank system, in particular also with respect to a sufficient tightness. This may take place according to the invention by using gas transport device 21.

For this purpose, it is provided that the pressure of the purge gas prevailing in this section is continuously ascertained within the scope of a method according to the invention, at least temporarily during the operation of gas transport device 21 and simultaneously upon the actuation of (first) shutoff valve 20 integrated into first branch 4*a* of purge gas line 4 with the aid of a pressure sensor 22, which is integrated into first branch 4*a* of purge gas line 4 between gas transport device 21 and first shutoff valve 20. The operation of gas transport device 21 and first shutoff valve 20 takes place primarily with the goal of purging fuel vapor filter 3, the introduction of the purge gas into fresh gas tract 5 being controlled with the aid of first shutoff valve 20. Due to the actuation of first shutoff valve 20 by means of PWM, whereby this shutoff valve 20 is opened and closed multiple times according to a PWM signal to implement a defined opening state, a pressure oscillation develops in this section of first branch 4*a* of purge gas line 4, which may be ascertained and evaluated by the corresponding fluctuations of the measured values of pressure sensor 22. Based on the result of the evaluation, a distinction may be made between an operability and a malfunction of the fuel tank system, for example a sufficient or insufficient tightness of purge gas line 4 in this section of first branch 4*a* of purge gas line 4, since the formation of the pressure oscillation is more pronounced the more the observed section of first branch 4*a* of purge gas line 4 is shut off.

Figure 2:
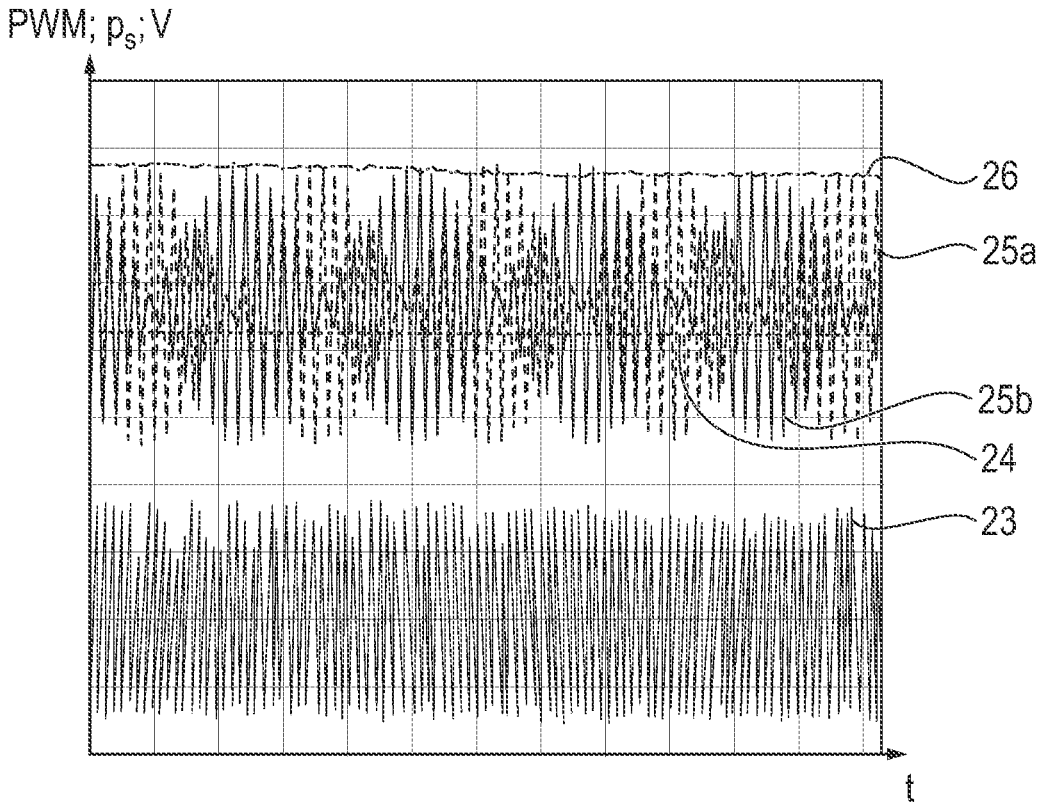
FIG. 2 shows value profiles measured and ascertained within the scope of a frequency diagnosis.

FIG. 2 illustrates this procedure, the curve drawn with the solid line showing profile 23 of the value, ascertained with the aid of pressure sensor 22, of the pressure of the purge gas, which represents a pressure oscillation. The dotted curve shows (constant) profile 24 of the PWM signal of the actuation of first shutoff valve 20. Curves 25*b* (dashed) and 25*b* (solid) represent the superimposition, ascertained from the pressure oscillation, of sinusoidal and cosinusoidal oscillations. Profile 26 of a comparison value V is ascertained from these superimposed sinusoidal and cosinusoidal oscillations 25. This comparison value V is compared with a setpoint value, which was derived from correspondingly superimposed sinusoidal and cosinusoidal oscillations, which were ascertained in a completely operational fuel tank system under corresponding operating conditions. If ascertained comparison value V deviates from the setpoint value beyond a tolerance limit or a limit value, a malfunction of the fuel tank system is derived therefrom, for example an insufficient tightness of the section of first branch 4*a* of purge gas line 4 situated between gas transport device 21 and first shutoff valve 20.

A frequency diagnosis of this type is carried out only if or while first shutoff valve 20 is actuated in a range of the PWM signal between a lower limit value, for example 20%, and an upper limit value, for example 80%. If the PWM signal is below the lower limit value or above the upper limit value, another form of the diagnosis for testing the function of the fuel tank system may be carried out within the scope of a method according to the invention.

For example, a pressure change diagnosis may be implemented, in which at least two pressure measurements are carried out with the aid of pressure sensor 22 while gas transport device 21 is being operated, the pressure measurements taking place upon different actuations of first shutoff valve 20. By means of a comparison of these pressure measurements, a pressure change in the form of a relative value (ps at point in time t1 in relation to ps at point in time t2) is ascertained and compared with a setpoint value, a distinction being made between an operability and a malfunction of the fuel tank system by means of this comparison of the difference value with the setpoint value.

Figure 3:
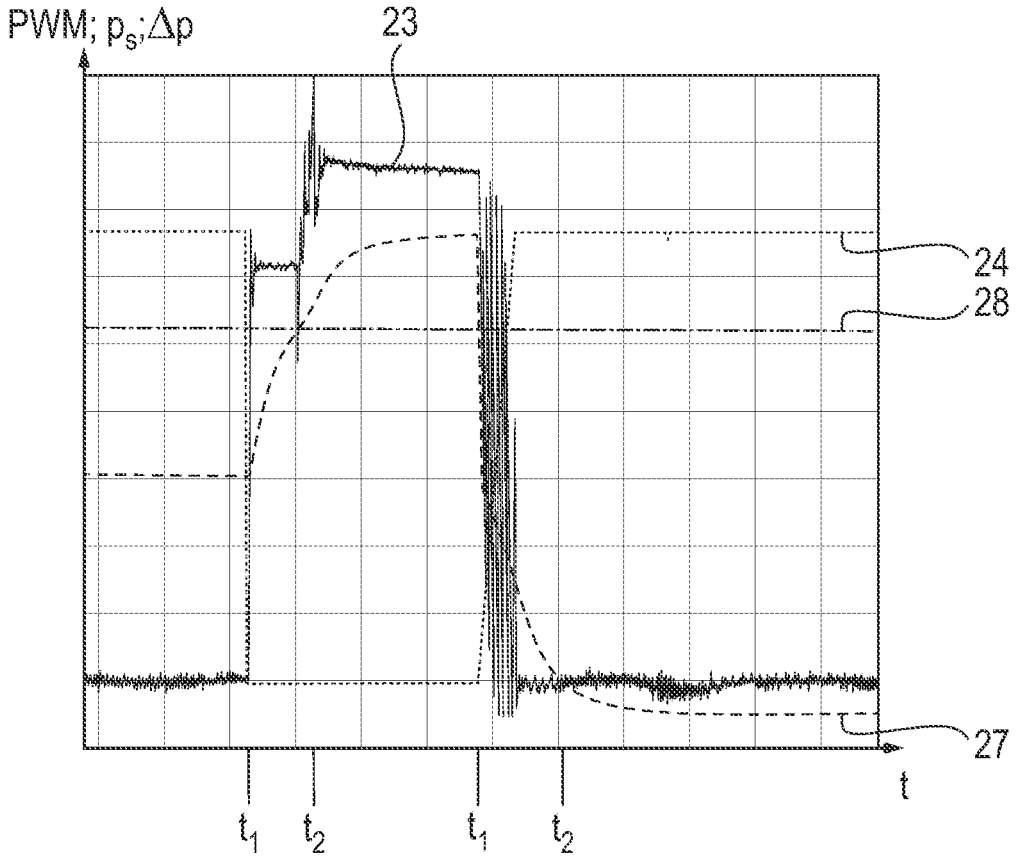
FIG. 3 shows value profiles measured and ascertained within the scope of a pressure change diagnosis.

FIG. 3 illustrates a corresponding procedure, the curve drawn with the solid line again showing profile 23 of pressure ps, ascertained with the aid of pressure sensor 22, of the purge gas. Profile 24 of the PWM signal of the actuation of first shutoff valve 20 is illustrated in a dash-dot manner, this shutoff valve 20 initially being open all the way (according to a PWM actuation of 100%), then quickly closed all the way (according to a PWM actuation of 0%) and briefly thereafter again quickly opened all the way. In the case of a gas transport device 21 operated with a constant load (cf. (constant) profile 28 of the PWM signal of the actuation of gas transport device 21 illustrated in FIG. 3), pressure ps of the purge gas in the area of pressure sensor 22 is much greater while holding first shutoff valve 20 closed than while holding it open. Profile 27 of pressure change Δp or corresponding relative values is illustrated with a dashed curve. The two pressure measurements are each carried out twice at points in time t1 and t2 marked in FIG. 3, i.e., once before and after the closing of first shutoff valve 20 and once before and after the opening thereof. The pressure change ascertained by a comparison of the values present at particular points in time t1 and t2 may be compared with a setpoint value in each case according to the pressure change diagnosis. Based on these comparisons, a distinction may be made between an operability and a malfunction of the fuel tank system.

Figure 4:
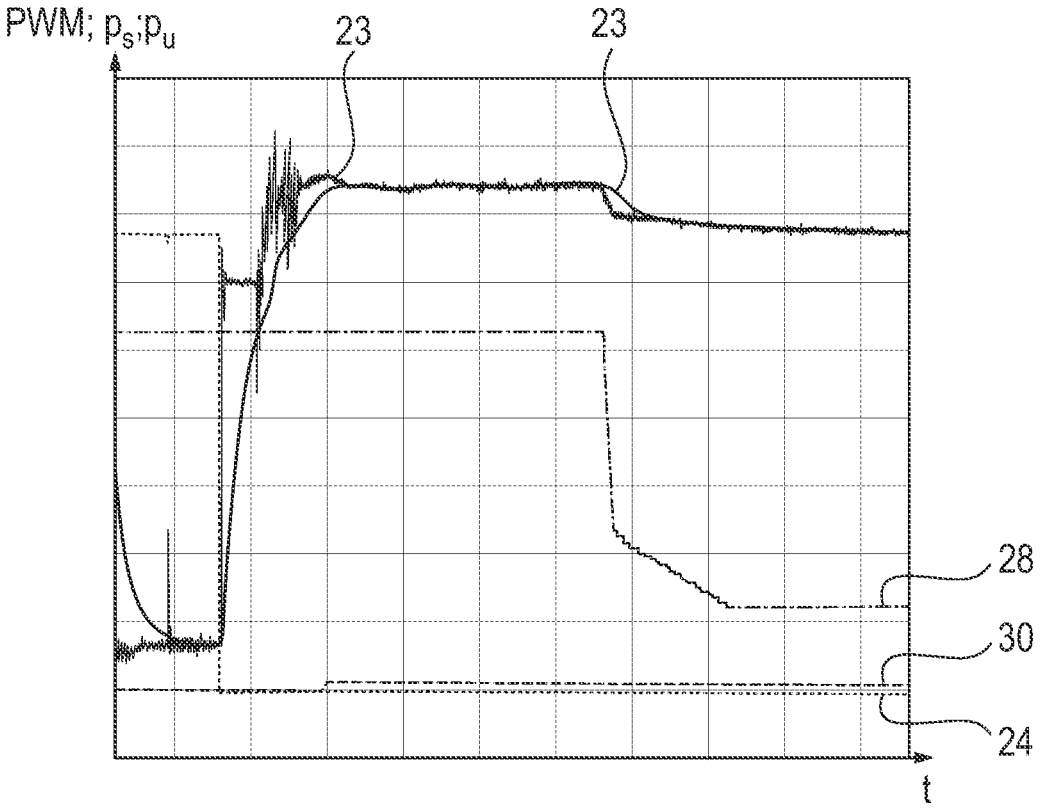
FIG. 4 shows value profiles measured and ascertained within the scope of an overpressure diagnosis.

According to FIG. 4, an overpressure diagnosis may furthermore be carried out, in which at least one pressure measurement is carried out with the aid of pressure sensor 22, and a pressure value is ascertained thereby, an analysis being carried out with respect to the presence of an overpressure by means of a comparison of this pressure value with a pressure value relating to ambient pressure pu, which was ascertained with the aid of an ambient pressure sensor 29, and, on this basis, a distinction is made between an operability and a malfunction. According to FIG. 4, first shutoff valve 20, which was initially opened all the way (according to a PWM actuation of 100%), is quickly closed (according to a PWM actuation of 0%) and subsequently held in the fully closed position (cf. profile curve 24). Gas transport device 21 is operated with a constantly high load or actuation (cf. profile curve 28) before and also for a period of time after the closing of first shutoff valve 20. This results in the fact that the profile of pressure ps of the purge gas ascertained with the aid of pressure sensor 22 abruptly increases (cf. profile curve 23) upon the rapid closing of first shutoff valve 20, while the ambient pressure essentially remains the same (cf. profile curve 30). Since, according to FIG. 4, pressure ps of the purge gas remains essentially constant with closed first shutoff valve 20 as long as gas transport device 21 is operated with a constant load, it may be inferred from the profile of this (over)pressure that no malfunction and, in particular, no insufficient tightness is present in the section of first branch 4*a* of purge gas line 4 situated between gas transport device 21 and first shutoff valve 20. Otherwise, a more or less rapid decrease in the pressure profile would be detectable, despite closed shutoff valve 20 and despite the operation of gas transport device 21 with a constant load.

An ascertainment of a malfunction with the aid of an overpressure diagnosis may also be based on the fact that measured pressure ps does not rise or does not rise rapidly enough despite closed shutoff valve 20 and despite the operation of gas transport device 21. For example, it may be provided that gas transport device 21 is not deactivated during a startup of combustion unit 7, so that the pressure in the purge gas line may approximately correspond to the ambient pressure. If gas transport device 21 is then placed into operation while first shutoff valve 20 is closed, no (sufficient) pressure buildup may be ascertained as a fault pattern if, for example, gas transport device 21 has a defect and/or if the section of first branch 4*a* of purge gas line 4 between gas transport device 21 and pressure sensor 22 has become detached or is clogged and/or if the section of first branch 4*a* of purge gas line 4 between pressure sensor 22 and first shutoff valve 20 has become detached.

An individual measurement may be sufficient for carrying out an overpressure diagnosis if the corresponding measured value is compared with a comparison value which indicates how high pressure ps is supposed to be in an operational fuel tank system and, in particular, a sufficiently tight section of first branch 4*a* of purge gas line 4, which is situated between gas transport device 21 and first shutoff valve 20, during a corresponding operation of gas transport device 21 and a correspondingly (in particular completely) closed first shutoff valve 20. However, at least two pressure measurements may also be carried out with the aid of pressure sensor 22 to be able to determine by a comparison of these measurement results whether, in which way and to what extent the profile of pressure ps of the purge gas changes.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for testing the function of a fuel tank system of an internal combustion engine, the method comprising:

providing the fuel tank system comprising a fuel tank, a fuel vapor filter that is fluid-conductively connected to a surroundings opening, a venting line leading from the fuel tank to the fuel vapor filter, a purge gas line leading from the fuel vapor filter to a fresh gas tract of the internal combustion engine, a gas transport device integrated into the purge gas line for transporting purge gas through the purge gas line, a shutoff valve arranged between an opening of the purge gas line into the fresh gas tract and the gas transport device in the purge gas line, and a pressure sensor integrated into the purge gas line;

operating the gas transport device and actuating the shutoff valve via a PWM;

opening and closing the shutoff valve multiple times according to a PWM signal for implementing a defined opening state;

ascertaining and evaluating a pressure oscillation of the purge gas, which results due to the corresponding opening and closing movements of the shutoff valve, via the pressure sensor according to a frequency diagnosis, and making a distinction between an operability and a malfunction based on the result of the evaluation.

2. The method according to claim 1, wherein it is evaluated whether the pressure oscillation corresponds to a superimposed sinusoidal and cosinusoidal oscillation.

3. The method according to claim 2, wherein the malfunction is detected if the pressure oscillation does not correspond to a superimposed sinusoidal and cosinusoidal oscillation.

4. The method according to claim 1, wherein, if the pressure oscillation corresponds to a superimposed sinusoidal and cosinusoidal oscillation, a comparison value is ascertained from the detected superimposed sinusoidal and cosinusoidal oscillation, which is compared wire a setpoint value, a/the malfunction being detected in the case of a deviation from the setpoint value.

5. The method according to claim 1, wherein the frequency diagnosis is carried out while the shutoff valve is being actuated in a range of the PWM signal between a lower limit value and an upper limit value.

6. The method according to claim 1, wherein, according to a pressure change diagnosis during an operated gas transport device, at least two pressure measurements are carried out with the aid of the pressure sensor, the pressure measurements taking place upon different actuations of the shutoff valve, and a pressure change ascertained by a comparison of these pressure measurements being compared with a setpoint value, a distinction being made between the operability and the malfunction by this comparison.

7. The method according to claim 5, wherein, during the pressure change diagnosis, at least one of the pressure measurements is carried out upon an actuation of the shutoff valve using a PWM signal which is greater than the upper limit value.

8. The method according to claim 1, wherein, according to an overpressure diagnosis, at least one pressure measurement is carried out with the aid of the pressure sensor, and a pressure value is ascertained thereby, an analysis with regard to the presence of an overpressure being carried out by a comparison of the pressure value with an ambient pressure value, which was ascertained with the aid of an ambient pressure sensor, a distinction being made between the operability and the malfunction as a function of the presence of the overpressure.

9. The method according to claim 5, wherein the overpressure diagnosis is carried out upon an actuation of the shutoff valve using a PWM signal which is less than the lower limit value.

* * * * *